US011725296B2

(12) United States Patent
Shamoto et al.

(10) Patent No.: US 11,725,296 B2
(45) Date of Patent: Aug. 15, 2023

(54) PLATE, PLATING APPARATUS, AND METHOD OF MANUFACTURING PLATE

(71) Applicant: EBARA CORPORATION, Tokyo (JP)

(72) Inventors: Mitsuhiro Shamoto, Tokyo (JP); Masashi Shimoyama, Tokyo (JP); Shao Hua Chang, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/314,491

(22) Filed: May 7, 2021

(65) Prior Publication Data

US 2021/0355596 A1 Nov. 18, 2021

(30) Foreign Application Priority Data

May 12, 2020 (JP) ..... 2020-083568

(51) Int. Cl.

| | |
|---|---|
| ***C25D 17/00*** | (2006.01) |
| ***C25D 3/02*** | (2006.01) |
| ***C25D 17/14*** | (2006.01) |
| ***C25D 21/12*** | (2006.01) |

(52) U.S. Cl.

CPC ..... *C25D 17/001* (2013.01); *C25D 3/02* (2013.01); *C25D 17/008* (2013.01); *C25D 17/14* (2013.01); *C25D 21/12* (2013.01)

(58) Field of Classification Search

CPC ..... C25D 17/008; C25D 17/002

See application file for complete search history.

(56) References Cited

U.S. PATENT DOCUMENTS

| | | | | |
|---|---|---|---|---|
| 6,106,687 | A * | 8/2000 | Edelstein | C25D 17/001 205/98 |
| 6,456,918 | B2 * | 9/2002 | Nanri | F16H 61/66254 701/55 |
| 9,653,339 | B2 * | 5/2017 | Olson | H01L 21/68728 |
| 10,876,208 | B2 * | 12/2020 | Chang | C23C 16/4583 |
| 2001/0040100 | A1 * | 11/2001 | Wang | H01L 21/4846 205/261 |
| 2001/0050233 | A1 * | 12/2001 | Uzoh | C25D 17/008 205/291 |
| 2003/0155231 | A1 * | 8/2003 | Weng | C25D 17/008 204/227 |
| 2004/0262150 | A1 | 12/2004 | Toshikazu et al. | |
| 2012/0000786 | A1 * | 1/2012 | Mayer | C25D 17/02 205/143 |

(Continued)

FOREIGN PATENT DOCUMENTS

| | | | | |
|---|---|---|---|---|
| CN | 101448983 | * | 6/2009 | C25D 5/08 |
| JP | 2002-167685 | A | 6/2002 | |
| JP | 2004-225129 | A | 8/2004 | |

(Continued)

*Primary Examiner* — Stefanie S Wittenberg

(74) *Attorney, Agent, or Firm* — BakerHostetler

(57) ABSTRACT

Provided is a plate that is arranged between a substrate and an anode in a plating tank. This plate has a plurality of circular pores on each one of at least three reference circles that are concentric with each other and that are different from each other in diameter. The plurality of circular pores include three circular pores that are arranged respectively on adjacent three of the at least three reference circles, and that have centers which are out of alignment with each other on an arbitrary radius on the plate.

6 Claims, 5 Drawing Sheets

(56) References Cited

U.S. PATENT DOCUMENTS

2012/0305404 A1* 12/2012 Keigler ..... C25D 17/008
205/96

FOREIGN PATENT DOCUMENTS

JP 2006144120 * 6/2006 ..... C25D 17/008
JP 2019108605 * 7/2019 ..... C25D 17/001
WO WO2004/009879 A1 1/2004

* cited by examiner

PLATE, PLATING APPARATUS, AND METHOD OF MANUFACTURING PLATE

TECHNICAL FIELD

Cross-Reference to Related Application

This application is based upon and claims benefit of priority from Japanese Patent Application No, 2020-083568 filed on May 12, 2020, the entire contents of which are incorporated herein by reference.

The present invention relates to a plate, a plating apparatus, and a method of manufacturing the plate.

BACKGROUND ART

Hitherto, wiring, formation of bumps (protruding electrodes), and the like on surfaces of substrates such as a semiconductor wafer or a printed substrate have been performed. Electrolytic plating has been known as a method of performing the wiring, the formation of bumps, and the like.

As is known, in plating apparatuses to be used in the electrolytic plating, an adjustment plate having a large number of pores is arranged between the circular substrate such as the wafer and an anode (refer, for example, to Patent Literatures 1 and 2).

CITATION LIST

Patent Literature

PTL 1: Japanese Patent Application Laid-open No, 2004-225129

PTL 2: International Publication No. WO 2004/009879

SUMMARY OF INVENTION

Technical Problem

Under circumstances in which a seed layer to be formed over the substrate has become thinner and thinner, what is called a terminal effect is liable to occur. The terminal effect is a phenomenon in which, due to high resistance at a central part of the substrate, a film thickness increases at edge parts of the substrate, which are near electrodes, and the film thickness decreases in a central portion of the substrate. When the plate is made of an electrically insulating material, influence of the terminal effect can be reduced. However, when uniformity in distribution density of the pores (or porosity) that are formed through the plate varies from region to region on the plate, film-thickness distribution that depends on arrangement positions of the pores may be adversely affected.

The present invention has been made in view of the problem as described above, and one of objects thereof is to suppress a local anisotropy of distribution of pores to be formed through a plate.

Solution to Problem

According to an aspect of the present invention, there is provided a plate that is arranged between a substrate and an anode in a plating tank. This plate has a plurality of circular pores on each one of at least three reference circles that are concentric with each other and that are different from each other in diameter.

The plurality of circular pores include three circular pores that are arranged respectively on adjacent three of the at least three reference circles, and that have centers which are out of alignment with each other on an arbitrary radius on the plate.

According to another aspect of the present invention, there is provided a plating apparatus. This plating apparatus includes:

the plate; and the plating tank that houses the plate.

According to a still another aspect of the present invention, there is provided a method of manufacturing a plate that is arranged between a substrate and an anode in a plating tank, the plate having a plurality of circular pores. The method of manufacturing the plate includes:

determining a region radius being a radius of a region in which the plurality of circular pores are formed through the plate, a pore diameter of the plurality of circular pores, and a target porosity in the region of the region radius;

dividing the region into a plurality of annular divided regions having predetermined widths on the basis of the region radius; the pore diameter; and the target porosity; and forming the plurality of circular pores on a plurality of reference circles that are located respectively in the plurality of annular divided regions on the plate in a manner that three circular pores of the plurality of circular pores are arranged respectively on adjacent three of the plurality of reference circles, and that centers of the three circular pores are out of alignment with each other on an arbitrary radius on the plate.

DESCRIPTION OF EMBODIMENTS

Figure 1:
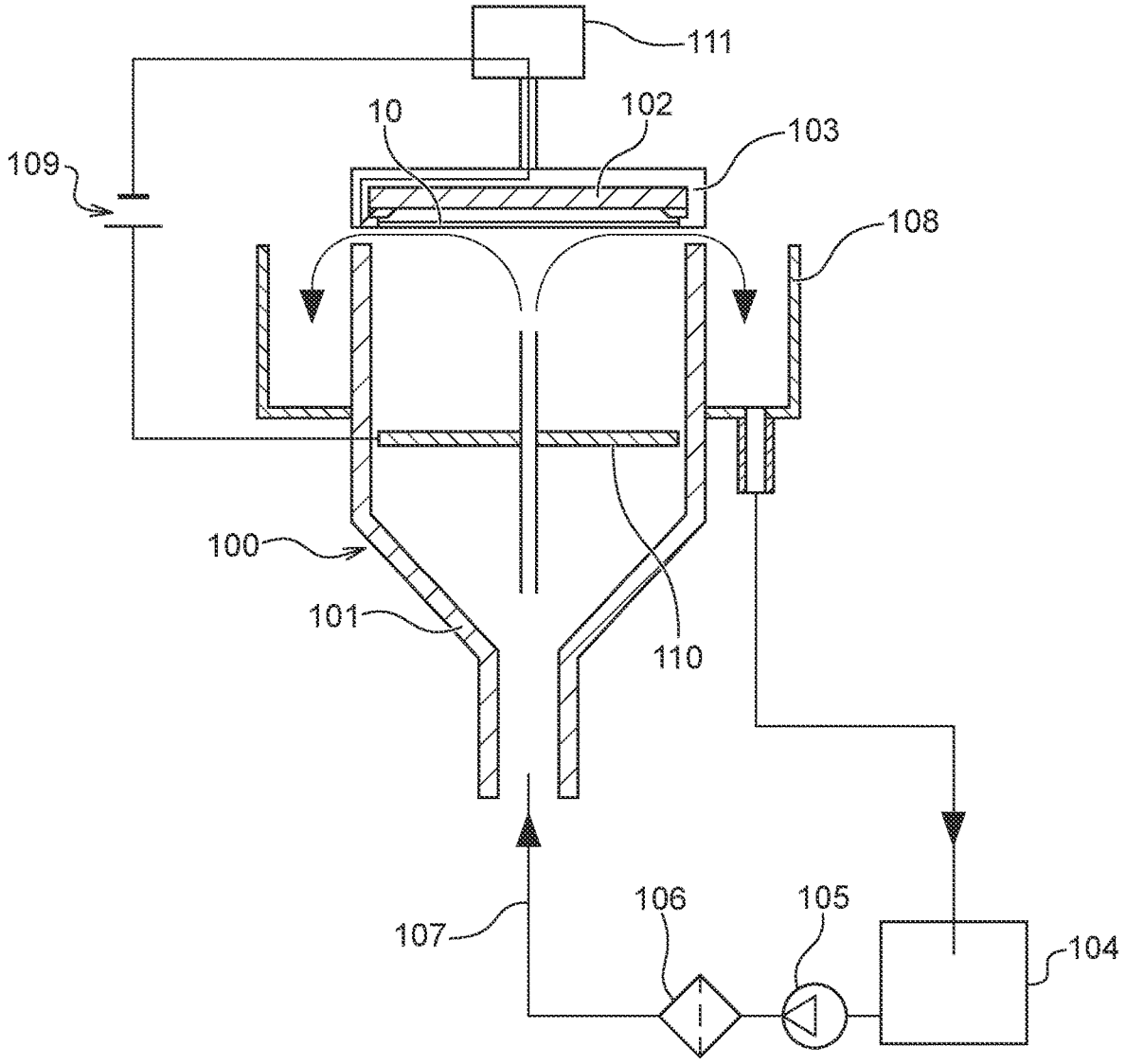
FIG. 1 is a schematic view illustrating an example of a plating apparatus including a plate according to an embodiment of the present invention.

Now, an embodiment of the present invention is described with reference to the drawings. In the drawings referred to below, the same or corresponding components are denoted by the same reference symbols to omit redundant description thereof. FIG. 1 is a schematic view illustrating an example of a plating apparatus including a plate according to this embodiment. As illustrated in FIG. 1. this plating apparatus 100 according to this embodiment is a plating apparatus 100 of what is called a face-down type or a cup type.

The plating apparatus 100 includes a plating tank 101, a substrate holder 103, and a storage tank 104. The substrate holder 103 is configured to hold a substrate 102 such as a wafer with its plating-target surface facing downward. The plating apparatus 100 includes a motor that rotates the substrate holder 103 in its circumferential direction. In the plating tank 101, an anode 110 is arranged to face the substrate 102.

The plating apparatus 100 further includes a recovery tank 108. Plating liquid in the storage tank 104 is supplied by a pump 105 from a bottom portion of the plating tank 101 into the plating tank 101 through a filter 106 and a supply pipe 107. The plating liquid that has overflowed from the plating tank 101 is recovered by the recovery tank 108, and then returns to the storage tank 104.

The plating apparatus 100 further includes a power supply 109 that is connected to the substrate 102 and the anode 110. While the motor 111 rotates the substrate holder 103, the power supply 109 applies predetermined voltage between the substrate 102 and the anode 110 such that plating current flows from the anode 110 to the substrate 102. In this way, a. plating film is formed over the plating-target surface of the substrate 102.

Figure 2:
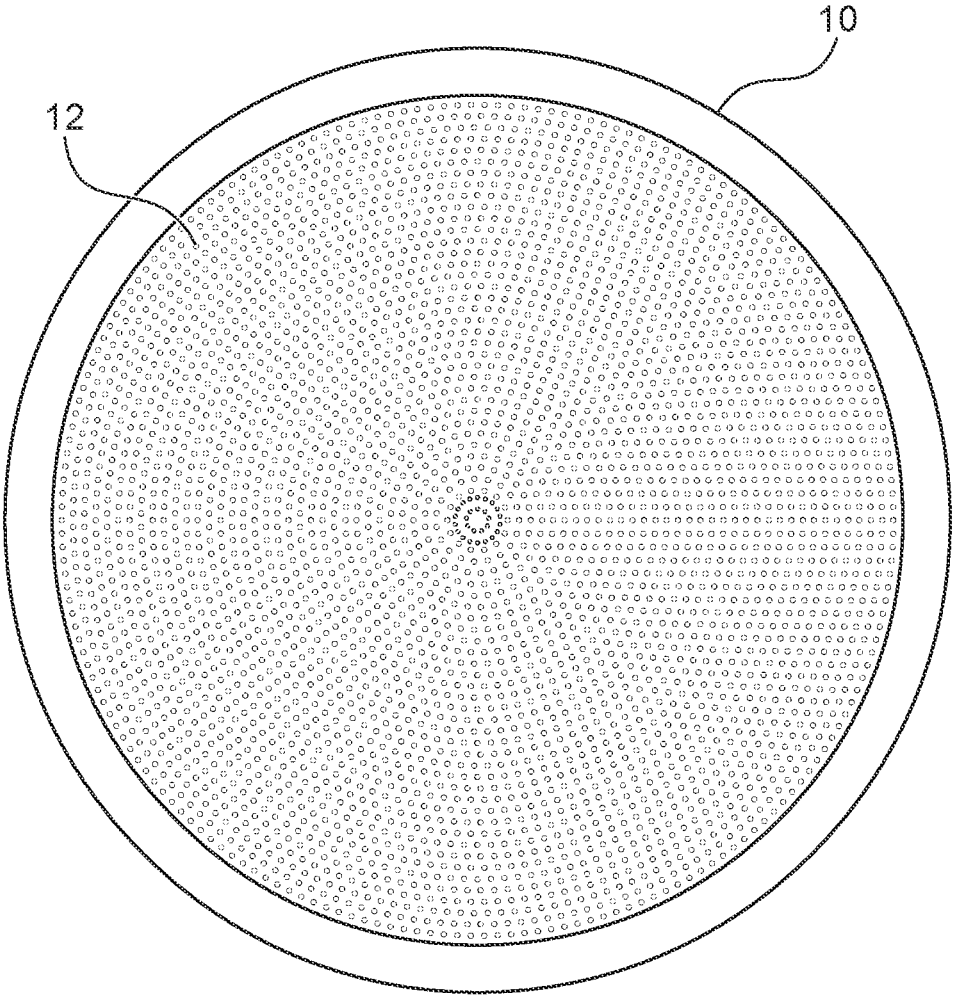
FIG. 2 is a front view of a plate.

A plate 10 is arranged between the substrate 102 and the anode 110. FIG. 2 is a. front view of the plate 10. As illustrated in FIG. 2, the plate 10 includes a plurality of circular pores 12. The pores 12 are formed through the plate 10 from its front surface to its rear surface, With this, passages that allow the plating liquid and ions in the plating liquid to pass therethrough are formed.

The plurality of pores 12 of the plate 10 according to this embodiment are arranged on at least three virtual reference circles that are concentric with each other and are different from each other in diameter. In other words, the plurality of pores 12 are arranged in a distributed manner in a radial direction of the plate 10. In addition, the pores 12 of the plate 10 are arranged in a manner that three pores 12 of the pores 12 are arranged respectively on adjacent three of the reference circles, and centers of the three pores 12 are out of alignment with each other on an arbitrary radius on the plate 10. In other words, three pores 12 of the plurality of pores 12 are spaced away from each other in the radial direction of the plate 10, and are not arranged in series on the arbitrary radius on the plate 10. With this, the pores 12 are suppressed from being densely arranged on the arbitrary radius on the plate 10. Thus, a local anisotropy of distribution of the pores 12 can be suppressed.

Further, it is preferred that the plurality of pores 12 of the plate 10 be arranged at an equal pitch along a circumferential direction of a corresponding one of the reference circles. This enables the pores 12 to be arranged in a distributed manner along the circumferential directions of the reference circles. Nate that, the term "equal pitch" used herein is not limited to the mathematically-perfect equal pitch, and may encompass a certain amount of tolerance due to errors in machining or the like.

Still further, on the plate 10, it is preferred that a difference between a diameter of an arbitrary one of the reference circles and a diameter of adjacent another one of the reference circles be constant. In other words, it is preferred that the pores 12 be arranged at an equal pitch in the radial direction. This enables the pores 12 to be arranged in a distributed manner in the radial directions of the reference circles. Note that, the term "equal pitch" used herein is not limited to the mathematically-perfect equal pitch, and may encompass the certain amount of the tolerance due to the errors in machining or the like.

Figure 3:
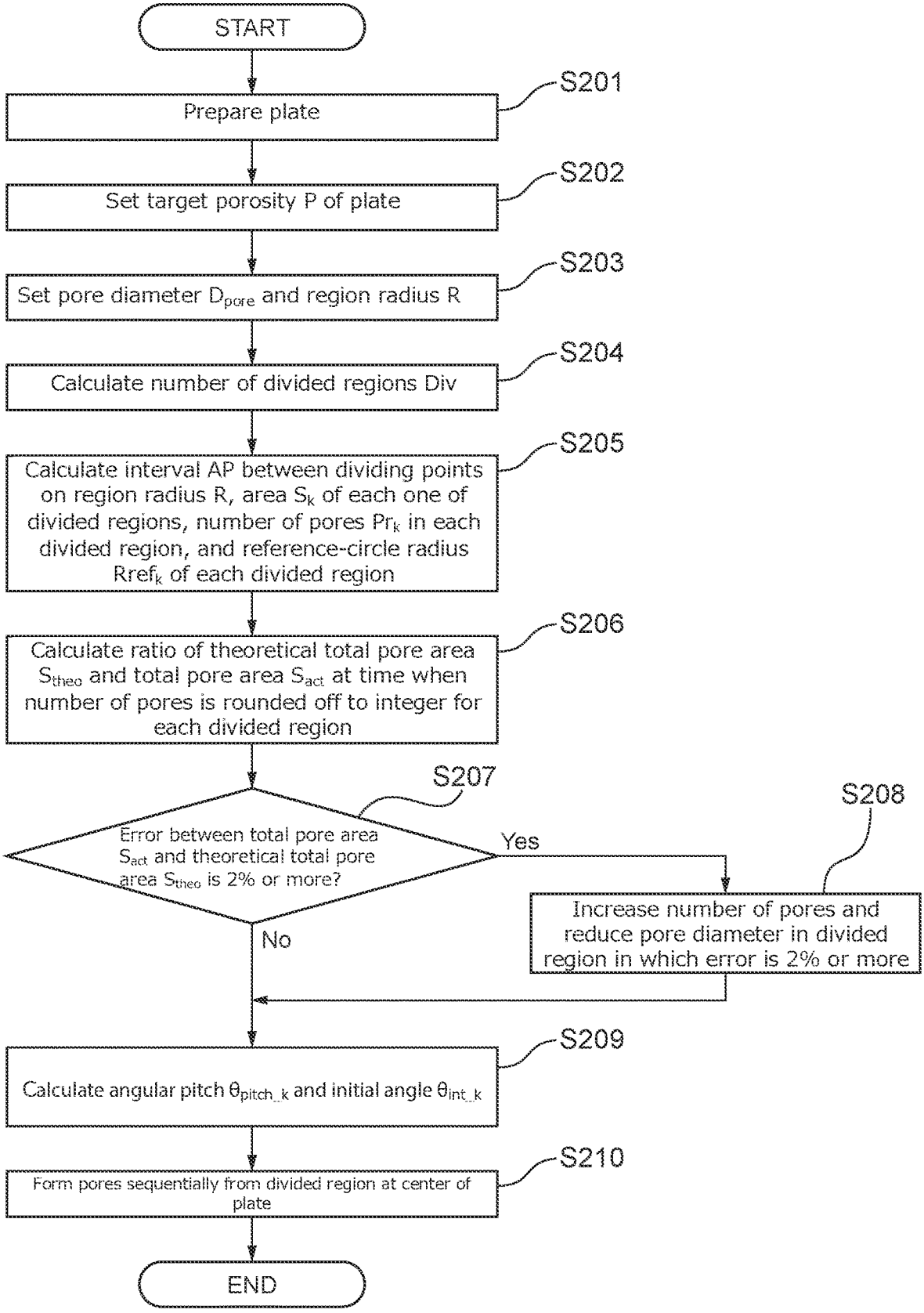
FIG. 3 is a flowchart showing a procedure of manufacturing the plate.

Now, a method of manufacturing the plate 10 is described. FIG. 3 is a flowchart showing a procedure of manufacturing the plate 10. First, a raw plate 10 without the pores 12 is prepared (Step S201). The raw plate 10 without the pores 12 is made, for example, of an electrically insulating material such as PVC (polyvinyl chloride). Then, a target porosity P of the raw plate 10 is set (Step S202). Note that, the porosity can be expressed by "Total Area of All Plurality of Pores 12/Total Area of Regions in Which Pores 12 Are Formed (Region Area)." In addition, the target porosity P is a porosity to be used as a target in the procedure of manufacturing the plate 10. The target porosity P can be calculated to be an appropriate value in advance by experiments or simulations. Specifically, since the target porosity P to be calculated varies as appropriate in accordance with a distance between the substrate 102 and the plate 10, the appropriate target porosity P can be calculated by the experiments or the simulations on the basis of the distance between the substrate 102 and the plate 10 in the plating apparatus 100 illustrated in FIG. 1.

Next, a pore diameter $D_{pore}$ of the pores 12 to be formed through the plate 10 and a region radius R are set (Step S203). A size of the pore diameter $D_{pore}$ may be arbitrarily set on the basis of empirical rules or the like within a possible range of machining. The region radius R is a radius of a circular region on the plate 10, in which the pores 12 are formed and which can be arbitrarily set on the basis of, for example, a size of the plating tank 101, the substrate 102, or the anode 110 illustrated in FIG. 1. Note that, in this embodiment, phrases "radial direction" and "circumferential direction" are respective abbreviations for a "radial direction along the region radius R" and a "circumferential direction relative to the region radius R."

After the target porosity P, the pore diameter $D_{pore}$ and the region radius R are set, the number of divided regions Div is calculated (Step S204). Note that, the divided regions are annular regions which have a certain width and respectively in which the at least three reference circles that are concentric with each other and that are different from each other in diameter are arranged. Thus, by determining the number of divided regions Div, a degree of the distribution of the pores 12 to be arranged in the direction of the region radius R is determined.

Figure 4:
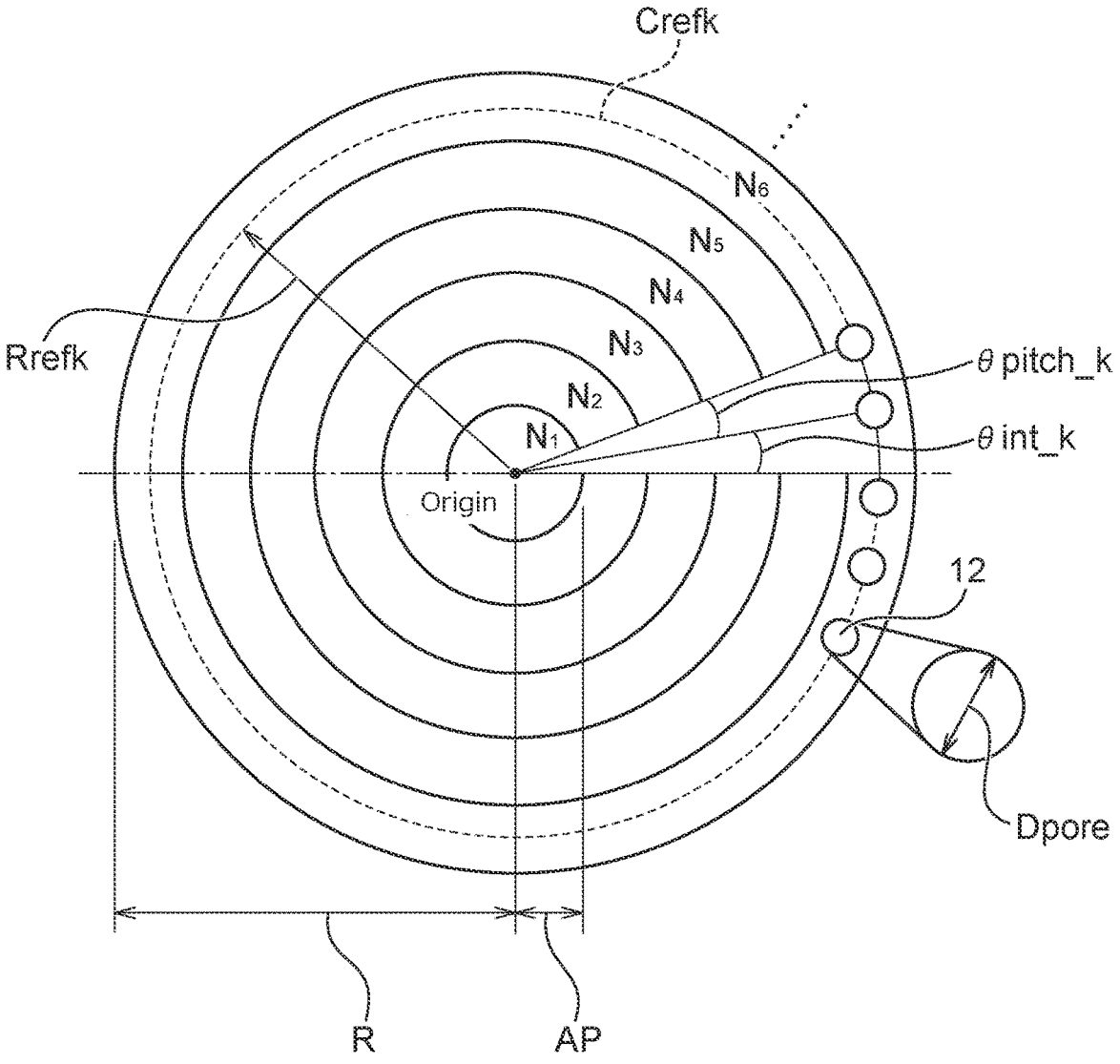
FIG. 4 is a schematic view illustrating regions which are defined across a region radius of the plate and in which pores are formed.

FIG. 4 is a schematic view illustrating the regions which are defined across the region radius R of the plate 10 and in which the pores 12 are formed. In the illustrated. example, the number of divided regions Div is six, and divided regions $N_1$, $N_2$, $N_3$, $N_4$, $N_5$, and $N_6$ are illustrated sequentially from a center side toward an outer side of the region radius R. A reference circle $Cref_k$ indicates positions at which the plurality of pores 12 are arranged, that is, a circle formed by connecting dots at a center of the width of each of the divided regions $N_k$. Note that, in this embodiment, "k" is a variable representing numbers of the divided regions (1 to 6 in this embodiment). The divided region $N_1$ includes a center of the region radius R, and is circular unlike the other divided region $N_2$ to divided region $N_6$. A reference-circle radius $Rref_k$ is a radius relative to the center of the region radius R of all the reference circles $Cref_k$.

As illustrated in FIG. 4, the region radius R corresponds to an outer diameter of a largest one of the divided regions $N_k$ (divided region $N_6$ in the illustrated example). In addition, an interval AP between dividing points on the region radius R is an interval in the radial direction between a circumference of each of the divided regions $N_k$ and a circumference of an adjacent divided region $N_{k+1}$ (or divided region $N_{k-1}$). In other words, the interval AP between the dividing points on the region radius R can be regarded also as the width of each of the divided regions $N_k$.

The pores 12 of the plate 10 have the pore diameter A pore area $S_{pore}$ of each of the pores 12 can be expressed by "(Pore Diameter $D_{pore}$/2)^2*π." One of the pores 12 on the reference circle $Cref_k$ in each of the divided regions $N_k$ is arranged at a position at an initial angle $\theta_{int_k}$ relative to the arbitrary radius, and other ones of the pores 12 are each arranged sequentially away from the preceding one of the pores 12 at an angular pitch $\theta_{pitch_k}$. Details of the initial angle $\theta_{int_k}$ and the angular pitch $\theta_{pitch_k}$ are described below.

Figure 5:
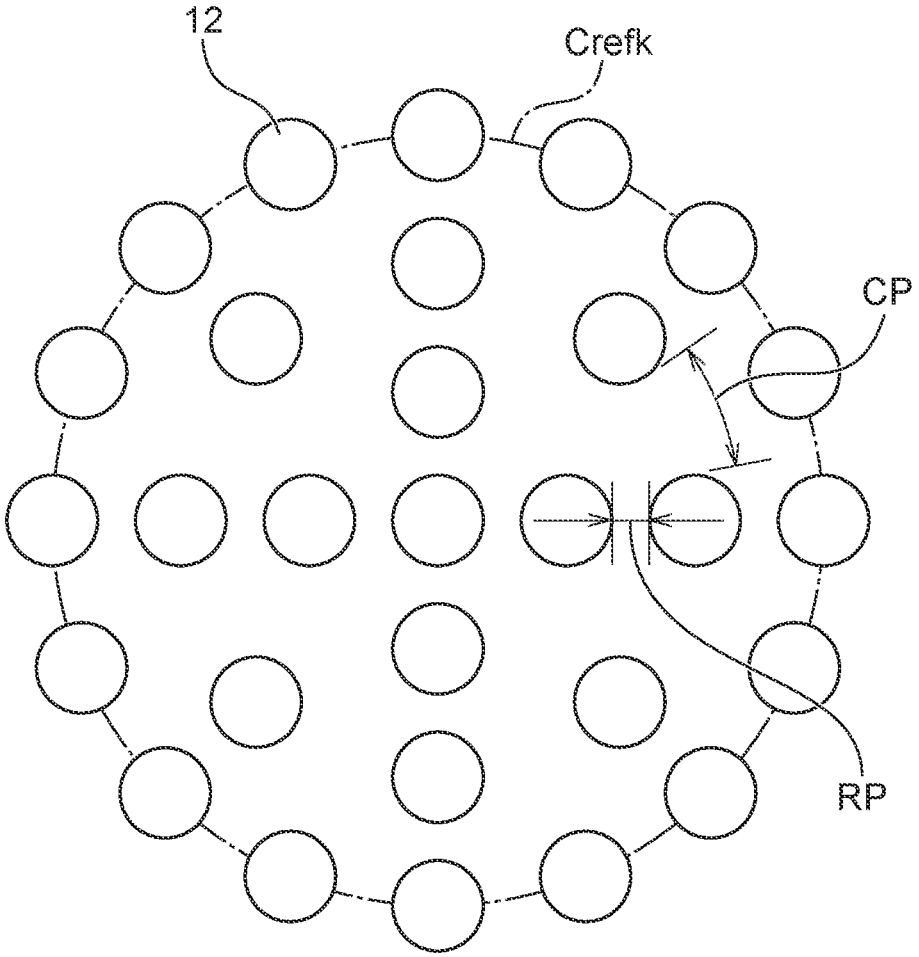
FIG. 5 is an explanatory schematic view of a relationship between a circumferential pitch and a radial pitch between the plurality of pores.

FIG. 5 is an explanatory schematic view of a relationship between a circumferential pitch and a radial pitch between the plurality of pores 12. As illustrated in FIG. 5, a circumferential pitch CP between the plurality of pores 12 corresponds to a clearance in the circumferential direction between the plurality of pores 12 to be arranged on the reference circle $Cref_k$ in each of the divided regions $N_k$. Meanwhile, a radial pitch RP between the plurality of pores 12 corresponds to a clearance in the direction of the region radius R between the plurality of pores 12 to be arranged respectively on the reference circles $Cref_k$ in adjacent two of the divided regions $N_k$. Note that, in order that the plurality of pores 12 are arranged in a uniformly distributed manner over the plate 10, it is preferred that the circumferential pitch CP between the plurality of pores 12 to be arranged on the reference circle $Cref_k$ in each of the divided regions $N_k$ and the radial pitch RP in the direction of the region radius R between the plurality of pores 12 to be arranged respectively on the reference circles $Cref_k$ in the adjacent two of the divided regions $N_k$ be equal to or approximate to each other.

Thus, by setting the circumferential pitch CP and the radial pitch RP between the plurality of pores 12 equal to each other, the number of divided regions Div can be calculated from the target porosity P. the pore diameter $D_{pore}$, and the region radius R. Specifically, the number of divided regions Div can be expressed by the following formula.

Number of Divided Regions Div=ROUND(SQRT((4*Region Radius R^2*Target Porosity $P$)/Pore Diameter $D_{pore}$^2*π))

At the number of divided regions Div to be calculated by this formula, the circumferential pitch CP and the radial pitch RP can be approximated to each other. Note that, in this embodiment, Round function is used to round off the number of divided regions Div to an integer. As a matter of course, other arbitrary functions that round off calculation results to integers may be used.

Then, the interval AP between the dividing points on the region radius R, an area $S_k$ of each of the divided regions, the number of pores $Pr_k$ in each of the divided regions, and the reference-circle radius $Rref_k$ of each of the divided regions are calculated (Step S205). In this embodiment, the respective widths of the divided regions $N_k$ are equal to each other, and these widths are each equal to the interval AP. Therefore, as can be expressed by (Region Radius R/Number of Divided Regions Div), the interval AP can be calculated from the region radius R and the number of divided regions Div.

The area $S_k$ of each of the divided regions can be calculated after the interval AP is determined. Specifically, as can be expressed by "(Interval AP*(k−0.5))^2*π−(Interval AP*(k−1.5))^2*π," the area $S_k$ of each of the divided regions can be calculated from the interval AP.

The number of pores $Pr_k$ in each of the divided regions can be calculated from the area $S_k$ of each of the divided regions, the target porosity P, and the pore diameter $D_{pore}$. Specifically, the number of pores $Pr_k$ in each of the divided regions can be expressed by the following formula.

Number of Pores $Pr_k$ in Each One of Divided Regions=ROUND((Area $S_k$ of Each One of Divided Regions*Target Porosity $P$)/Pore Area $S_{pore}$)

Note that, in this embodiment, Round function is used to round off the number of pores $Pr_k$ in each of the divided regions to an integer. As a matter of course, other arbitrary functions that round off calculation results to integers may be used.

The reference-circle radius $Rref_k$ can be calculated from the interval AP between the dividing points on the region radius R. Specifically, the reference-circle radius $Rref_k$ can be expressed by (Interval AP*(k−0.5)).

As described above, by the process of Step S205, the number $Pr_k$ of the pores 12 to be formed in each of the divided regions $N_k$ is calculated. However, the number of pores $Pr_k$ in the divided region $N_k$ is rounded off to an integer halfway in the calculation. In addition, the area $S_k$ of each of the divided regions, which is used for calculating the number of pores $Pr_k$ in each of the divided regions $N_k$, is derived from the number of divided regions Div, which has been rounded off to an integer. Therefore, a total pore area $S_{act}$ (=Number of Pores $Pr_k$ in Each One of Divided Regions $N_k$*Pore Area $S_{pore}$) to be calculated from the number of pores $Pr_k$ in each of the divided regions $N_k$ and a theoretical total pore area $S_{theo}$ to be calculated from the target porosity P may be unequal to each other. As a precaution, an error between the total pore area $S_{act}$ (total area of pores 12) to be calculated on the basis of the number of pores $Pr_k$ in one of the divided regions $N_k$, and the theoretical total pore area $S_{theo}$ (theoretical total area of pores 12) to be calculated on the basis of the target porosity P in the one of the divided regions $N_k$ is calculated. Specifically, in this embodiment, a ratio of the theoretical total pore area $S_{theo}$ and the total pore area $S_{act}$ to be calculated from the number of pores $Pr_k$ that has been rounded off to an integer is calculated for each of the divided regions $N_k$ (Step S206). Specifically, this ratio is expressed by (Total Pore Area $S_{act}$/Theoretical Total Pore Area $S_{theo}$*100).

Next, it is determined whether or not the error between the calculated total pore area. $S_{act}$ and the calculated theoretical total pore area $S_{theo}$ is equal to or more than a predetermined value. If the error is equal to or more than the predetermined value, the number $Pr_k$ of the pores 12 in a corresponding one of the divided regions $N_k$ is increased, and the pore diameter $D_{pore}$ in the same is reduced. Specifically, in this embodiment, if the error between the total pore area $S_{act}$ and the theoretical total pore area $S_{theo}$ is 2% or more (Yes in Step S207), the number of pores $Pr_k$ in the corresponding one of the divided regions $N_k$ is increased by 2.25 times, and the pore diameter $D_{pore}$ in the same is reduced to ⅔ (Step S208). If a value of the number of pores $Pr_k$ that has been increased by 2.25 times is a decimal, this value may be rounded off to an integer by the arbitrary functions. With this, in the corresponding one of the divided regions $N_k$, the pores 12 are reduced in size while increased in number, and hence the total pore area $S_{act}$ can be further approximated to the theoretical total pore area $S_{theo}$. Note that, although the number of pores $Pr_k$ and the pore diameter $D_{pore}$ at this time can respectively be increased and reduced by arbitrary factors, it is preferred to adopt factors by which the porosity to be calculated from the number of pores $Pr_k$ and the pore diameter $D_{pore}$ does not vary as a result of the calculation.

In Step S207, if the error between the theoretical total pore area $S_{theo}$ and the total pore area $S_{act}$ is less than 2% (No in Step S207), the procedure proceeds to a process of Step S209.

By the processes of Step S202 to Step S208, the number of divided regions Div, that is, the number of the pores 12 to be arranged in the radial direction, the radial pitch RP, and the number of the pores 12 to be arranged in the circumferential direction on the reference circle $Cref_k$ in each of the divided regions $N_k$ are determined. Next, an arrangement angle between the pores 12 in each of the reference circles $Cref_k$ can be determined. Specifically, the angular pitch $\theta_{pitch_k}$ and the initial angle $\theta_{int_k}$ between the pores 12 to be arranged in each of the divided regions $N_k$ are calculated (Step S209). First, the angular pitch $\theta_{pitch_k}$ between the pores 12 is expressed by (360°/Number of Pores $Pr_k$ in Each One of Divided Regions $N_k$).

Now, a method of calculating the initial angle $\theta_{int_k}$ is described. In this embodiment, the initial angle $\theta_{int_k}$ is an angle of a pore 12 to be a reference relative to the arbitrary radius of the reference circle $Cref_k$. The plurality of pores 12 to be formed through the plate 10 are arranged on the reference circle $Cref_k$ at the angular pitch $\theta_{pitch_k}$ sequentially from the reference pore 12. In this embodiment, at the initial angle $\theta_{int_k}$ to be calculated, three pores 12 of the pores 12 are arranged respectively on the adjacent three of the reference circles $Cref_k$, and centers of the three pores 12 are out of alignment with each other on the arbitrary radius. Specifically, for example, at the initial angle $\theta_{int_k}$ to be calculated for pores 12 to be arranged respectively from the divided region $N_k$ to a divided region $N_k$+2, these pores 12 are arranged respectively from the reference circle $Cref_k$ in the divided region $N_k$ to a reference circle $Cref_{k+2}$ in the divided region $N_{k+2}$, and are out of alignment with each other on the same radius.

In this embodiment, as an example, an initial angle $\theta_1$ in the divided region $N_1$ is defined as an angular pitch $\theta_{pitch_1}$, and an initial angle $\theta_2$ in the divided region $N_2$ is defined as (Angular Pitch $\theta_{pitch_1}$+Initial Angle $\theta_1$/2). Subsequently, an initial angle $\theta_3$ in the divided region $N_3$ is defined as (Angular Pitch $\theta_{pitch_1}$+(Initial Angle $\theta_1$+Initial Angle $\theta_2$)/2). In other words, an initial angle $\theta_1$ in an arbitrary divided region $N_k$ can be calculated by the following formula.

$$\theta i = \theta \text{pitch_i} + \sum_{k=2}^{i} \theta(k-1)/2 \quad \text{[Formula 1]}$$

In addition, as another example, the initial angle $\theta_1$ in the divided region $N_1$ is defined as the angular pitch $\theta_{pitch_1}$, and the initial angle $\theta_2$ in the divided region $N_2$ is defined as an angular pitch $\theta_{pitch_2}$. Subsequently, the initial angle $\theta_3$ in the divided region $N_3$ is defined as (Angular Pitch $\theta_{pitch_3}$+(Initial Angle $\theta_1$+Initial Angle $\theta_2$)/2). In addition, an initial angle $\theta_4$ in the divided region $N_4$ is defined as an angular pitch $\theta_{pitch_4}$. Subsequently, an initial angle $\theta_5$ in the divided region $N_5$ is defined as (Angular Pitch $\theta_{pitch_5}$+(Initial Angle $\theta_1$+Initial Angle $\theta_2$+Initial Angle $\theta_3$+Initial Angle $\theta_4$)/2). In other words, the initial angle $\theta_1$ in the arbitrary divided region $N_k$ can be calculated by the following formula, where "i" is equal to 2n.

$$\theta i = \theta \text{pitch_}i \quad \text{[Formula 2]}$$

Alternatively, the initial angle $\theta_i$ in the arbitrary divided region $N_k$ can be calculated by the following formula, where "i" is equal to 2n+1.

$$\theta i = \theta \text{pitch_i} + \sum_{k=2}^{i} \theta(k-1)/2 \quad \text{[Formula 3]}$$

When the pores 12 are arranged on the reference circle $Cref_k$ in each of the divided regions $N_k$ at the initial angle $\theta_{int_k}$ and the angular pitch $\theta_{pitch_k}$ to be calculated as in the above-described two calculation examples, three pores 12 of the pores 12 are arranged respectively on adjacent three of the reference circles $Cref_k$, and centers of the three pores 12 are out of alignment with each other on the arbitrary radius on the plate 10. Note that. Formulae 1 to 3 described above are merely examples, and hence arbitrary initial angles $\theta_{int_k}$ at which three pores 12 of the pores 12 are arranged respectively on adjacent three of the reference circles $Cref_k$, and centers of the three pores 12 are out of alignment with each other on the arbitrary radius may be adopted.

After the initial angle $\theta_{int_k}$ and the angular pitch $\theta_{pitch_k}$ in each of the divided regions $N_k$ are calculated, in accordance with the parameters calculated in Step S202 to Step S209, the pores 12 are formed sequentially from the divided region $N_k$ on the center side of the plate 10, that is, sequentially from the divided region $N_1$ (Step S210).

As described above, the pores 12 of the plate 10 according to this embodiment include the three pores 12 that are arranged respectively on the adjacent three of the reference circles $Cref_k$, and that have the centers which are out of alignment with each other on the arbitrary radius on the plate 10. Thus, the pores 12 are suppressed from being densely arranged on the arbitrary radius, and hence the local anisotropy of the distribution of the pores 12 can be suppressed.

Further, the plurality of pores 12 of the plate 10 are arranged at the equal pitch along the circumferential direction of a corresponding one of the reference circles $Cref_k$. Thus, the pores 12 are suppressed from being densely arranged on the reference circles $Cref_k$, and hence the local anisotropy of the distribution of the pores 12 can be suppressed.

Still further, on the plate 10, the difference between the diameter of an arbitrary one of the reference circles $Cref_k$, on which the pores 12 are arranged, and a diameter of an adjacent reference circle $Cref_{k+r}$ is constant. In other words, the pores 12 are arranged at the equal pitch in the radial direction. Thus, the pores 12 are suppressed from being densely arranged in the radial direction, and hence the local anisotropy of the distribution of the pores 12 can be suppressed.

The embodiment of the present invention is described above for ease of understanding of the present invention, and hence the present invention is not limited thereto. As a matter of course, the present invention may be varied and modified within the gist thereof, and the present invention may encompass equivalents thereof. In addition, as long as at least some of the problems as described above can be solved, or as long as some of the advantages as described above can be obtained, the components described in Claims and herein may be arbitrarily combined with each other, or may be omitted.

Now, some of aspects disclosed herein are described.

According to a first aspect, there is provided a plate that is arranged between a substrate and an anode in a plating tank. The plate has a plurality of circular pores on each one of at least three reference circles that are concentric with each other and that are different from each other in diameter.

The plurality of circular pores include three circular pores that are arranged respectively on adjacent three of the at least three reference circles, and that have centers which are out of alignment with each other on an arbitrary radius on the plate.

According to the first aspect, the plurality of circular pores include the three circular pores that are arranged respectively on the adjacent three of the at least three reference circles, and that have the centers which are out of alignment with each other on the arbitrary radius. Thus, the plurality of circular pores are suppressed from being densely arranged on the arbitrary radius, and hence a local anisotropy of distribution of the plurality of circular pores can be suppressed.

A gist of a second aspect resides in that the plurality of circular pores of the plate according to the first aspect are arranged at an equal pitch along a circumferential direction of a corresponding one of the at least three reference circles.

According to the second aspect, the plurality of circular pores are arranged at the equal pitch along the circumferential direction of the corresponding one of the at least three reference circles. Thus, the plurality of circular pores are suppressed from being densely arranged on the at least three reference circles, and hence the local anisotropy of the distribution of the plurality of circular pores can be suppressed.

A gist of a third aspect resides in that, on the plate according to the first aspect or the second aspect, a difference between a diameter of an arbitrary one of the at least three reference circles and a diameter of adjacent another one of the at least three reference circles is constant.

According to the third aspect, the plurality of circular pores are arranged at an equal pitch in a radial direction. Thus, the plurality of circular pores are suppressed from being densely arranged in the radial direction, and hence the local anisotropy of the distribution of the plurality of circular pores can be suppressed.

According to a fourth aspect, there is provided a plating apparatus. The plating apparatus includes:

the plate according to any of the first aspect to the third aspect; and the plating tank that houses the plate.

According to a fifth aspect, there is provided a method of manufacturing a plate that is arranged between a substrate and an anode in a plating tank, the plate having a plurality of circular pores. The method of manufacturing the plate includes:

determining a region radius being a radius of a region in which the plurality of circular pores are formed through the plate, a pore diameter of the plurality of circular pores, and a target porosity in the region of the region radius;

dividing the region into a. plurality of annular divided regions having predetermined widths on the basis of the region radius, the pore diameter, and the target porosity; and forming the plurality of circular pores on a plurality of reference circles that are located respectively in the plurality of annular divided regions on the plate in a manner that three circular pores of the plurality of circular pores are arranged respectively on adjacent three of the plurality of reference circles, and that centers of the three circular pores are out of alignment with each other on an arbitrary radius on the plate.

According to the fifth aspect, three circular pores of the plurality of circular pores are arranged respectively on the adjacent three of the plurality of reference circles, and centers of the three circular pores which are out of alignment with each other on the arbitrary radius. Thus, the plurality of circular pores are suppressed from being densely arranged on the arbitrary radius, and hence the local anisotropy of the distribution of the plurality of circular pores can be suppressed.

A gist of a sixth aspect resides in that, in the method of manufacturing the plate according to the fifth aspect, the predetermined widths of the plurality of annular divided regions are equal to each other, and in that the method of manufacturing the plate according to the fifth aspect further includes calculating the numbers of the plurality of circular pores to be formed respectively in the plurality of annular divided regions on the basis of the region radius, the pore diameter, and the target porosity.

A gist of a seventh aspect resides in that the method of manufacturing the plate according to the sixth aspect further includes:

calculating an error between a total area of ones of the plurality of circular pores in one of the plurality of annular divided regions, the total area being calculated on the basis of the number of the ones of the plurality of circular pores, and another total area of the ones of the plurality of circular pores in the one of the plurality of annular divided regions, the other total area being calculated on the basis of the target porosity; and increasing the calculated number of the ones of the plurality of circular pores and reducing the pore diameter in the one of the plurality of annular divided regions if the error is equal to or more than a predetermined value.

According to the seventh aspect, a total pore area to be calculated from the number of the plurality of circular pores in each of the plurality of annular divided regions can be further approximated to a theoretical total pore area to be calculated from the target porosity.

A gist of an eighth aspect resides in that, in the method of manufacturing the plate according to the sixth aspect or the seventh aspect, the plurality of reference circles in the plurality of annular divided regions are respectively located at centers of the predetermined widths of the plurality of annular divided regions.

According to the eighth aspect, the plurality of circular pores are arranged at an equal pitch in a radial direction. Thus, the plurality of circular pores are suppressed from being densely arranged in the radial direction, and hence the local anisotropy of the distribution of the plurality of circular pores can be suppressed.

A gist of a ninth aspect resides in that, in the method of manufacturing the plate according to any of the fifth aspect to the eighth aspect, the plurality of circular pores are arranged at an equal pitch along a circumferential direction of a corresponding one of the plurality of respective reference circles in the plurality of annular divided regions.

According to the ninth aspect, the plurality of circular pores are arranged at the equal pitch along the circumferential direction of the corresponding one of the plurality of reference circles. Thus, the plurality of circular pores are suppressed from being densely arranged on the plurality of reference circles, and hence the local anisotropy of the distribution of the plurality of circular pores can be suppressed.

REFERENCE SIGNS LIST

CP circumferential pitch
$Pr_k$ number of pores
$\theta_{int_k}$ initial angle
$Rref_k$ reference-circle radius
$Cref_k$ reference circle
AP interval $N_k$ divided region
$D_{pore}$ pore diameter
P target porosity
RP radial pitch
R region radius
Div number of divided regions
10 plate
100 plating apparatus
101 plating tank
102 substrate

What is claimed is:

1. A plating apparatus comprising:
a plating tank,
a substrate holder configured to hold a substrate,
an anode arranged to face the substrate holder, and
a single plate arranged between the substrate holder and the anode in the plating tank, the single plate having a plurality of circular pores on each one of at least three reference circles that are concentric with each other and centered on the single plate and that are different from each other in diameter,
the plurality of circular pores including three circular pores that are arranged respectively on adjacent three of the at least three reference circles and that have centers which are out of alignment with each other on substantially all arbitrary radii on the single plate that are inclusive of circular pores,
wherein the single plate comprises only circular pores that are substantially the same size.

2. The plating apparatus according to claim 1,
wherein the plurality of circular pores are arranged at an equal pitch along a circumferential direction of a corresponding one of the at least three reference circles.

3. The plating apparatus according to claim 1,
wherein a difference between a diameter of an arbitrary one of the at least three reference circles and a diameter of adjacent another one of the at least three reference circles is constant.

4. A plating apparatus comprising:
a plating tank,
a substrate holder configured to hold a substrate,
an anode arranged to face the substrate holder, and
a single plate arranged between the substrate holder and the anode in the plating tank, the single plate having a plurality of circular pores on each one of at least three reference circles that are concentric with each other and centered on the single plate and that are different from each other in diameter,
the plurality of circular pores including three circular pores that are arranged respectively on adjacent three of the at least three reference circles and that have centers which are out of alignment with each other on an arbitrary radius on the single plate that is inclusive of circular pores, wherein the single plate comprises no openings larger than the plurality of circular pores,
wherein each of the three circular pores have no substantial variation in size.

5. A plating apparatus comprising:
a plating tank,
a substrate holder configured to hold a substrate,
an anode arranged to face the substrate holder, and
a single plate arranged between the substrate holder and the anode in the plating tank, the single plate having a plurality of circular pores on each one of at least three reference circles that are concentric with each other and centered on the single plate and that are different from each other in diameter,
the plurality of circular pores including three circular pores that are arranged respectively on adjacent three of the at least three reference circles and that have centers which are out of alignment with each other on an arbitrary radius on the single plate that is inclusive of circular pores, wherein the single plate comprises only circular pores that are substantially the same size.

6. The plating apparatus according to claim 5, wherein the single plate comprises no openings substantially larger than the circular pores.

* * * * *